US011511329B2

(12) United States Patent
Dani

(10) Patent No.: US 11,511,329 B2
(45) Date of Patent: Nov. 29, 2022

(54) METHOD FOR OBTAINING A THREE-DIMENSIONAL CURVE IN A TUBULAR PRODUCT, AND METHOD FOR MANUFACTURING COMPLEX-CURVATURE TUBULAR PRODUCTS

(71) Applicant: CTE SISTEMI S.R.L., Genoa (IT)

(72) Inventor: Marco Dani, Genoa (IT)

(73) Assignee: CTE SISTEMI S.R.L., Genoa (IT)

( * ) Notice: Subject to any disclaimer, the term of this patent is extended or adjusted under 35 U.S.C. 154(b) by 0 days.

(21) Appl. No.: 17/206,535

(22) Filed: Mar. 19, 2021

(65) Prior Publication Data

US 2022/0184683 A1 Jun. 16, 2022

(30) Foreign Application Priority Data

Dec. 10, 2020 (IT) ..... 102020000030371

(51) Int. Cl.
*B21D 7/02* (2006.01)

(52) U.S. Cl.
CPC ..... *B21D 7/02* (2013.01)

(58) Field of Classification Search
CPC . B21D 7/02; B21D 7/022; B21D 7/08; B21D 11/10; B21D 11/06; B21F 3/02; B21F 3/027; B21F 3/08; B21F 35/04
See application file for complete search history.

(56) References Cited

U.S. PATENT DOCUMENTS 4,567,745 A * 2/1986 Schwarze ..... B21D 7/02 72/157
4,938,050 A * 7/1990 Kimura ..... B21D 11/10 72/306
5,111,675 A 5/1992 Murata
9,208,940 B2 * 12/2015 Kawashima ..... H01F 41/061

FOREIGN PATENT DOCUMENTS

WO 2020012376 A1 1/2020

* cited by examiner

*Primary Examiner* — Teresa M Ekiert
(74) *Attorney, Agent, or Firm* — Ferguson Case Orr Paterson

(57) ABSTRACT

A method for obtaining a three-dimensional curve in a tubular product starting from a tube extending along a rectilinear longitudinal axis includes performing, by a first bending device, a first bending operation on a bending plane passing through the rectilinear longitudinal axis (x), so that the tube leaving the first bending device has a curved portion lying on the plane of curvature, and performing on the tube leaving the first bending device, by a second bending device, a second bending operation, so that the curved portion of the tube at the output of the second bending device has a first tangent and a second tangent (t1, t2) at its opposite ends lying on a cylindrical surface having generatrices orthogonal to two planes (A1, A2) respectively containing the first and second tangents (t1, t2). A method for manufacturing complex-curvature tubular products is also provided.

7 Claims, 6 Drawing Sheets

METHOD FOR OBTAINING A THREE-DIMENSIONAL CURVE IN A TUBULAR PRODUCT, AND METHOD FOR MANUFACTURING COMPLEX-CURVATURE TUBULAR PRODUCTS

CROSS REFERENCE TO RELATED APPLICATION

This application claims priority to and the benefit of Italian Patent Application No. 102020000030371, filed on Dec. 10, 2020, which is fully incorporated by reference herein in its entirety.

FIELD OF THE INVENTION

The present invention generally relates to a method for manufacturing tubular products. In particular, the present invention relates to a method for manufacturing complex-curvature tubular products, that is, with immediately adjacent curved portions which are each curved on a respective plane of curvature.

The term "tubular product" used in the following description and claims refers to any product obtained from a tube (the cross section of which may have different shapes, in particular circular) or to an analogous elongated semi-finished product, such as a bar or a profile.

BACKGROUND OF THE INVENTION

Various methods are known for obtaining tubular products by performing bending operations on metal tubes. Generally, depending on the geometries to be obtained and the material of the tube, bending operations may be performed using, for example, roller-type or form-bound bending devices.

In bending by a roller-type bending device, an initially straight metal tube is fed in the direction of its longitudinal axis and passed between at least three rollers arranged alternately on opposite sides with respect to the tube, one of which is transversely movable, i.e., substantially orthogonal to the longitudinal axis of the tube. While the tube is made to advance in the direction of its own longitudinal axis, the more the movable roller is pressed against the tube towards the longitudinal axis of the tube, the smaller the bending radius of the tube obtained. By changing the relative orientation of the tube with respect to the bending device, that is, with respect to the three rollers of the bending device, it is possible to change the orientation of the bending plane of the tube in space.

Roller-type bending devices, despite ensuring high dimensional and geometric precision, are unsuitable for obtaining complex-curvature tubular products by performing in sequence various bends on immediately adjacent tube portions. In effect, a roller-type bending device plastically deforms the tube at the intermediate roller, while the other rollers must rest on curved or straight portions of tube lying on the plane of the tube. In particular, the problem of making immediately adjacent curved portions with curvatures lying on different bending planes is particularly difficult to deal with if, considering two adjacent curves, the first one to be made also has a particularly small bending radius.

WO 2020/012376 A1, in the name of the instant Applicant, directed to a method for manufacturing ELM (Edge Localized Mode) coils for nuclear fusion reactors, i.e., coils for controlling instabilities located at the edge of the plasma, solves the above-described problem. It relates to tubular products that have a particularly complex geometry, with a succession of immediately adjacent curved portions, and which must be made with very tight tolerances. The method provides for subjecting the tube to a first bending operation with a first bending device, whereby a plurality of first curved portions separated by second straight portions is made. The tube is then subjected to a second bending operation with a second bending device, through which second curved portions are made in the intervals between the first curved portions. The second curved portions may have a reduced bending radius. However, WO 2020/012376 A1 does not provide making curved portions with a reduced bending radius and having a three-dimensional development.

In the manufacture of ELM coils, a need is felt to make corner portions in which, in addition to the curvature necessary to make the corner of a substantially rectangular coil, an additional curvature in different planes is superimposed and/or adjacent to the "main" one, with the aim of obtaining a predetermined distance of the corner of the coil from the mounting surface thereof.

SUMMARY OF THE INVENTION

An object of the present invention is to provide a solution for making corner portions, with a reduced bending radius, so that curved portions have a three-dimensional development.

Another object of the present invention is to provide a solution for making curves having a three-dimensional development in a tubular product.

Therefore, the present invention is not limited to manufacturing ELM coils, but may be applied also to other types of complex-curvature tubular products.

The aforesaid objects are fully achieved, according to a first aspect of the present invention, by a method for obtaining a three-dimensional curve in a tubular product starting from a tube extending along a rectilinear longitudinal axis and, according to a further aspect of the present invention, by a method for manufacturing a complex-curvature tubular product starting from a tube extending along a rectilinear longitudinal axis, as described and claimed herein.

Advantageous embodiments are also described.

In short, the present invention relates to a method for obtaining a three-dimensional curve in a tubular product starting from a tube extending along a rectilinear longitudinal axis, the method comprising the steps of a) performing, by a first bending device, a first bending operation on a bending plane passing through said rectilinear longitudinal axis, in such a way that the tube leaving the first bending device comprises a curved portion having opposite ends, wherein a first tangent and a second tangent to the curved portion at said opposite ends lie on the bending plane; and b) performing a second bending operation on the tube leaving the first bending device, by a second bending device, so that the curved portion of the tube has the first and second tangents at said opposite ends lying on a cylindrical surface having generatrices orthogonal to a first plane containing the first tangent and a second plane containing the second tangent.

The present invention further relates to a method for manufacturing a complex-curvature tubular product starting from a tube extending along a rectilinear longitudinal axis, the method comprising the steps of a) performing, by a first bending device, a plurality of first bending operations, each bending operation of said plurality of first bending operations being performed on a respective first straight portion of the tube and on a respective second straight portion of the tube, and on a bending plane passing through said rectilinear longitudinal axis, whereby the tube leaving the first bending device comprises a respective plurality of first curved portions, separated by second curved portions, in which each inflection portion comprises a first curve and a second curve lying on said bending plane, each second curved portion having opposite ends, wherein a first tangent and a second tangent to the second curved portion at said opposite ends lie on a same bending plane; and b) performing on the tube leaving the first bending device, by a second bending device, a plurality of second bending operations, each bending operation of said plurality of second bending operations being performed on one of said second curved portions, in such a way that the tube leaving the second bending device comprises, between each pair of consecutive first curved portions, a respective bent curved portion having the first and second tangents at said opposite ends lying on a cylindrical surface having generatrices orthogonal to a first plane containing the first tangent and to a second plane containing the second tangent, wherein the complex-curvature tubular product thus obtained comprises first curved portions and immediately adjacent second bent curved portions.

The method of the present invention allows manufacturing complex-curvature tubular products, i.e., products with immediately adjacent curved portions or with three-dimensional curvature, such as ELM coils.

Further features and advantages of the present invention will be clarified by the detailed description that follows, given purely by way of non-limiting example with reference to the accompanying drawings.

DETAILED DESCRIPTION

Figure 1:
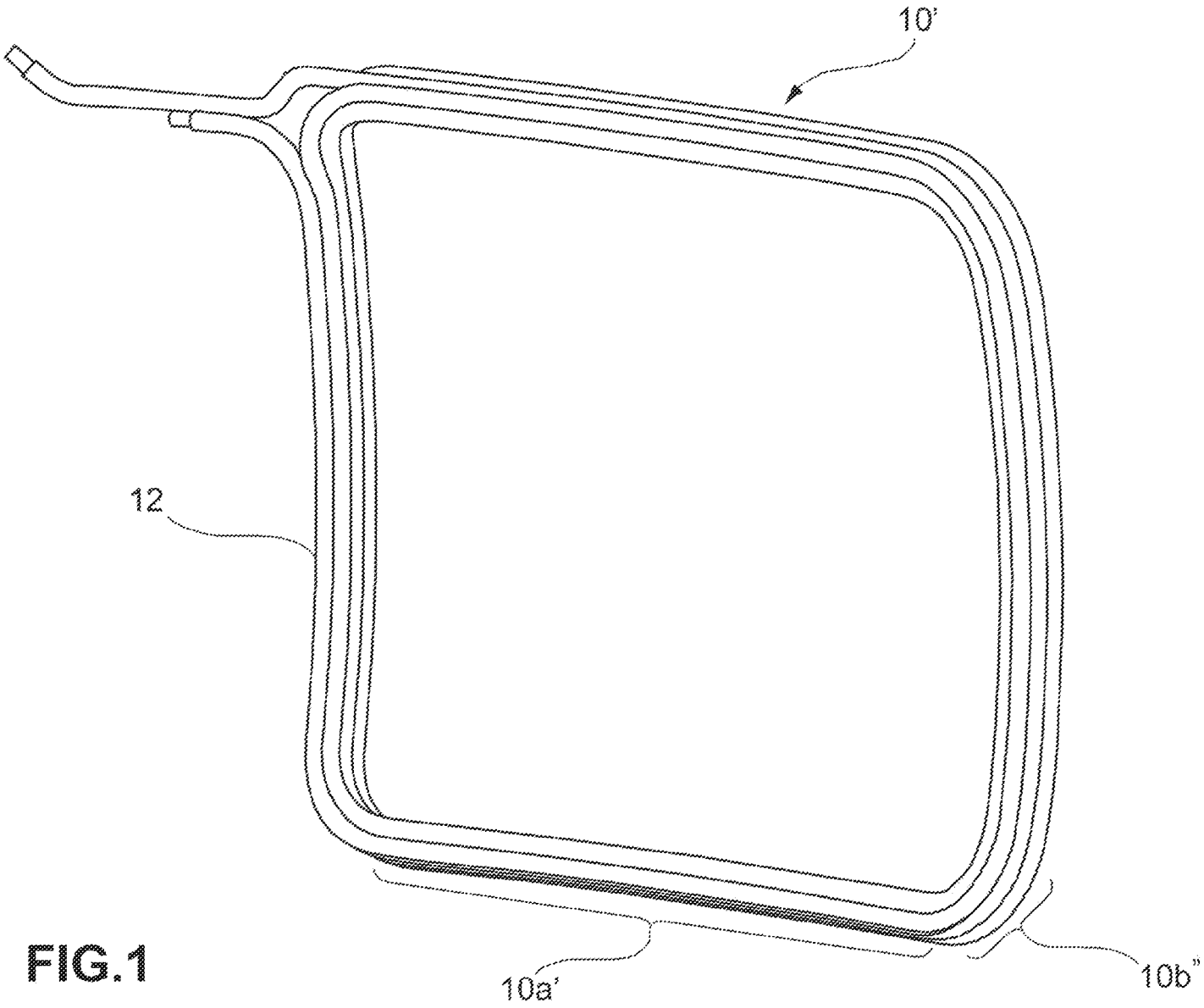
FIG. 1 is a perspective view of an ELM coil as an example of a complex-curvature tubular product obtainable by a method according to the present invention.

With initial reference to FIG. 1, a tubular product obtainable by a method according to the present invention is generally indicated with 10'. The tubular product 10' comprises first curved portions 10*a*' and second bent curved portions (in particular, corner portions) 10*b*" alternating with each other and immediately adjacent. In particular, the second bent curved portions or corner portions 10*b*" have a bending radius smaller than the bending radius of the first curved portions 10*a*'. As an example of a tubular product 10' obtainable by the method of the present invention, FIG. 1 shows an ELM coil, which comprises a plurality of turns 12, each turn having a plurality of curved sides, corresponding to the first curved portions 10*a*', and, between each pair of consecutive curved sides, a connecting portion, corresponding to a corner portion 10*b*", with a bending radius smaller than the bending radius of the curved sides. For example, the coil 10' may have six turns 12, each with four sides 10*a*', joined to each other by corner portions 10*b*". The number of turns and sides may vary, depending on different requirements the coil must meet.

Figure 2:
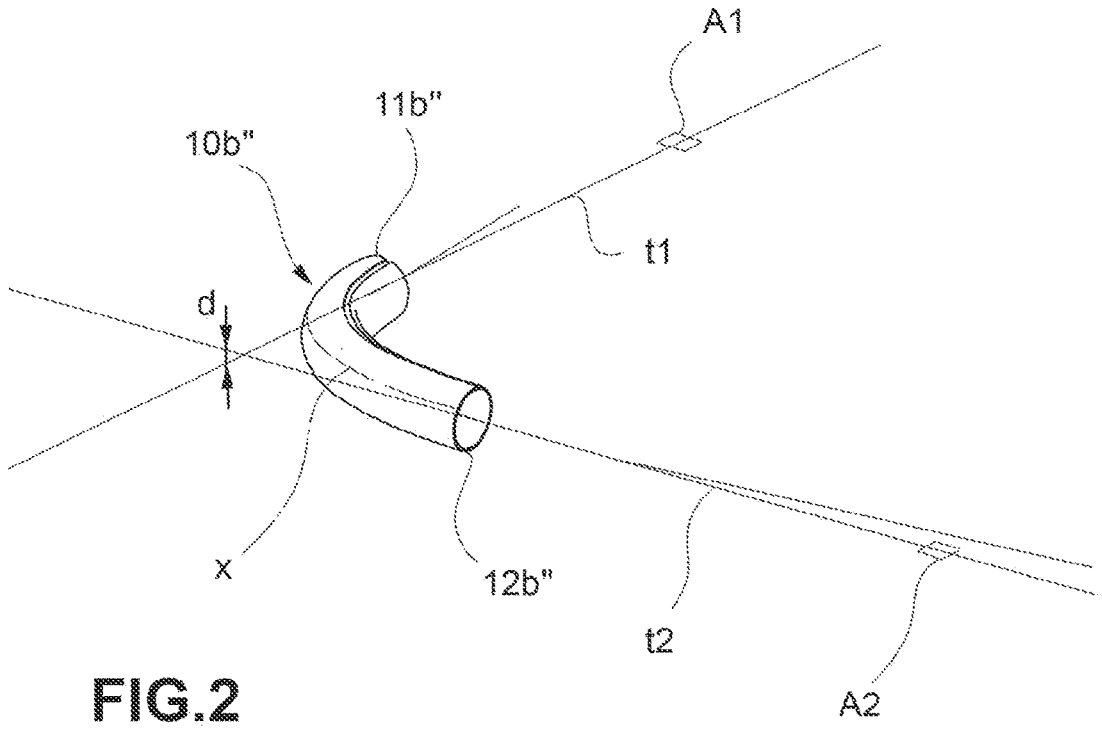
FIG. 2 is a perspective view showing a corner portion of the tubular product of FIG. 1.
Figure 3:
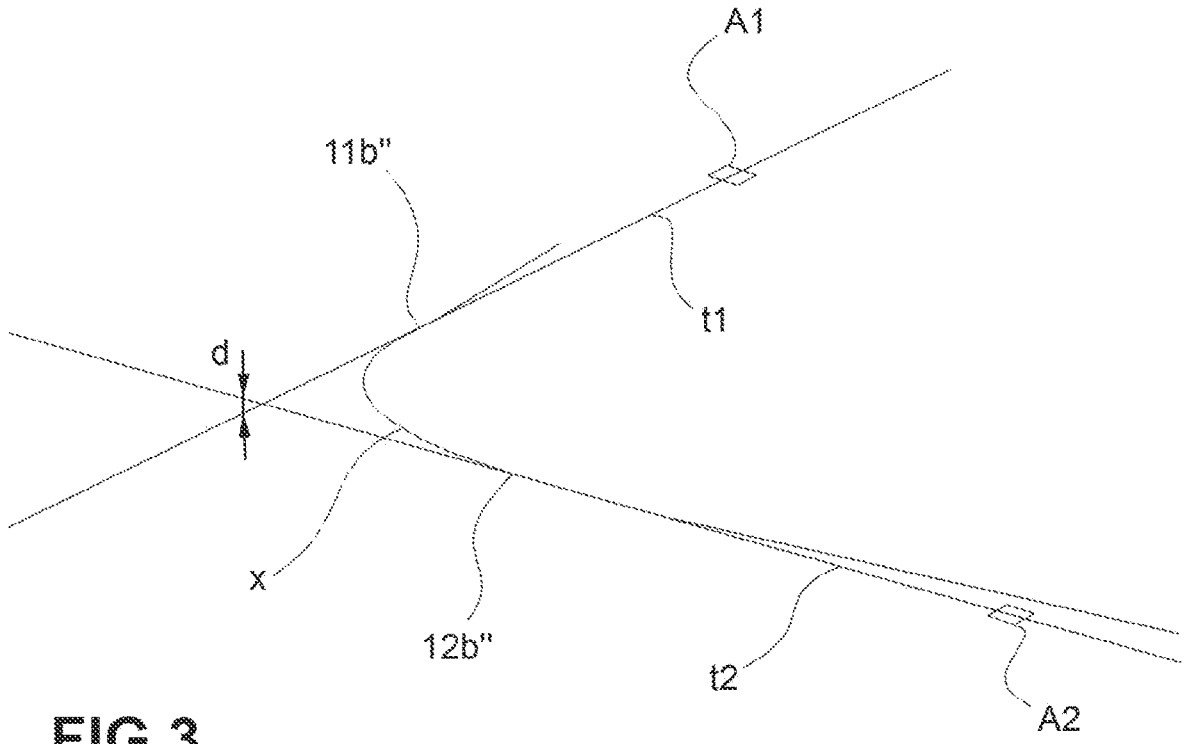
FIG. 3 is a view analogous to FIG. 2, in which only the central axis of the tube is shown, FIG. 4 schematically shows a first step of the method according to the present invention for obtaining the tubular product of FIG. 1.

With reference to FIGS. 2 and 3, a single second bent curved portion or corner portion 10*b*" of the tubular product or coil 10' is shown, in particular a corner portion arranged at one of the lower corners or at the upper right corner of the coil of FIG. 1. The central axis of the tubular product 10' is indicated with x. As shown in FIG. 3, the corner portion 10*b*" has a three-dimensional development; in other words, the central axis x does not lie in a plane. In the corner portion 10*b*" opposite ends 11*b*" and 12*b*" may be identified, at which the corner portion 10*b*" is joined to respective first curved portions 10*a*'.

The present invention arises from the general observation that, for two straight skew lines in space, there are two mutually parallel planes, each containing one of the straight lines. The planes, which will be referred to in the following as A1 and A2, are placed at a distance d from each other. The tangents t1, t2 to the corner portion 10*b*" (more precisely, the tangents t1, t2 to the central axis x of the corner portion 10*b*") at the opposite ends 11*b*" and 12*b*" of the angle portion 10*b*" lie on two respective planes A1 and A2 parallel to each other and placed at a distance d from each other.

In the illustrated example, the corner portion 10*b*" is formed by the superposition or combination of a smooth double S-curve and a sharp curve. In particular, the tangent t1 to the corner portion 10*b*" at the first end 11*b*" lies on a first plane A1, and the tangent t2 to the corner portion 10*b*" at the second end 12*b*" lies on a second plane A2, parallel to the first plane A1. The distance between the two planes A1 and A2 is indicated with d in FIGS. 2 and 3. The central axis x at the corner portion 10*b*" is shaped as a double S-curve lying on a cylindrical surface, the generatrices of which are orthogonal to the A1 and A2 planes. More generally, the central axis x at the corner portion 10*b*" is shaped as a double S-curve, the tangents of which to the ends of the double S-curve lie on a cylindrical surface, the generatrices of which are orthogonal to the A1 and A2 planes.

Figure 4:
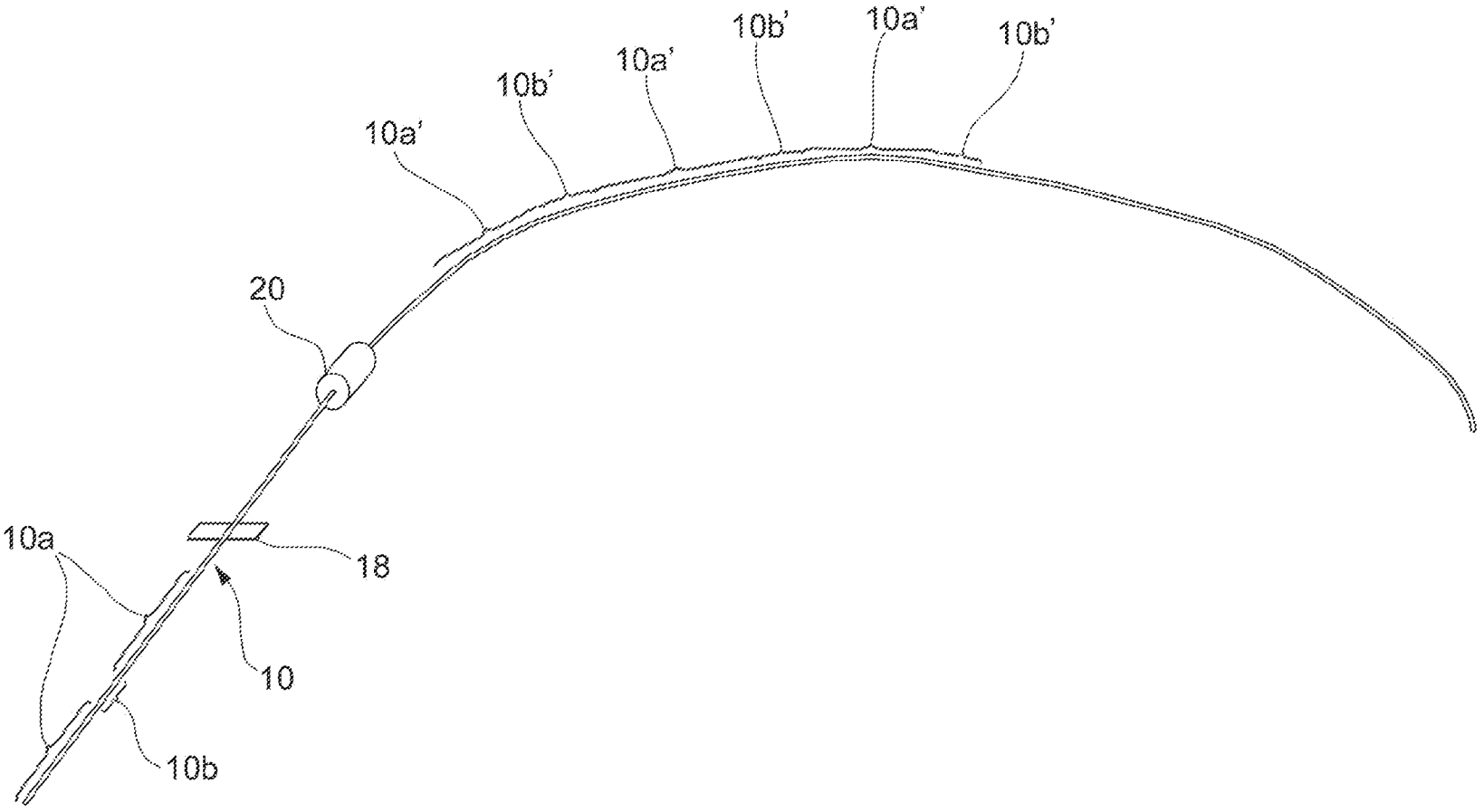
Figure 5:
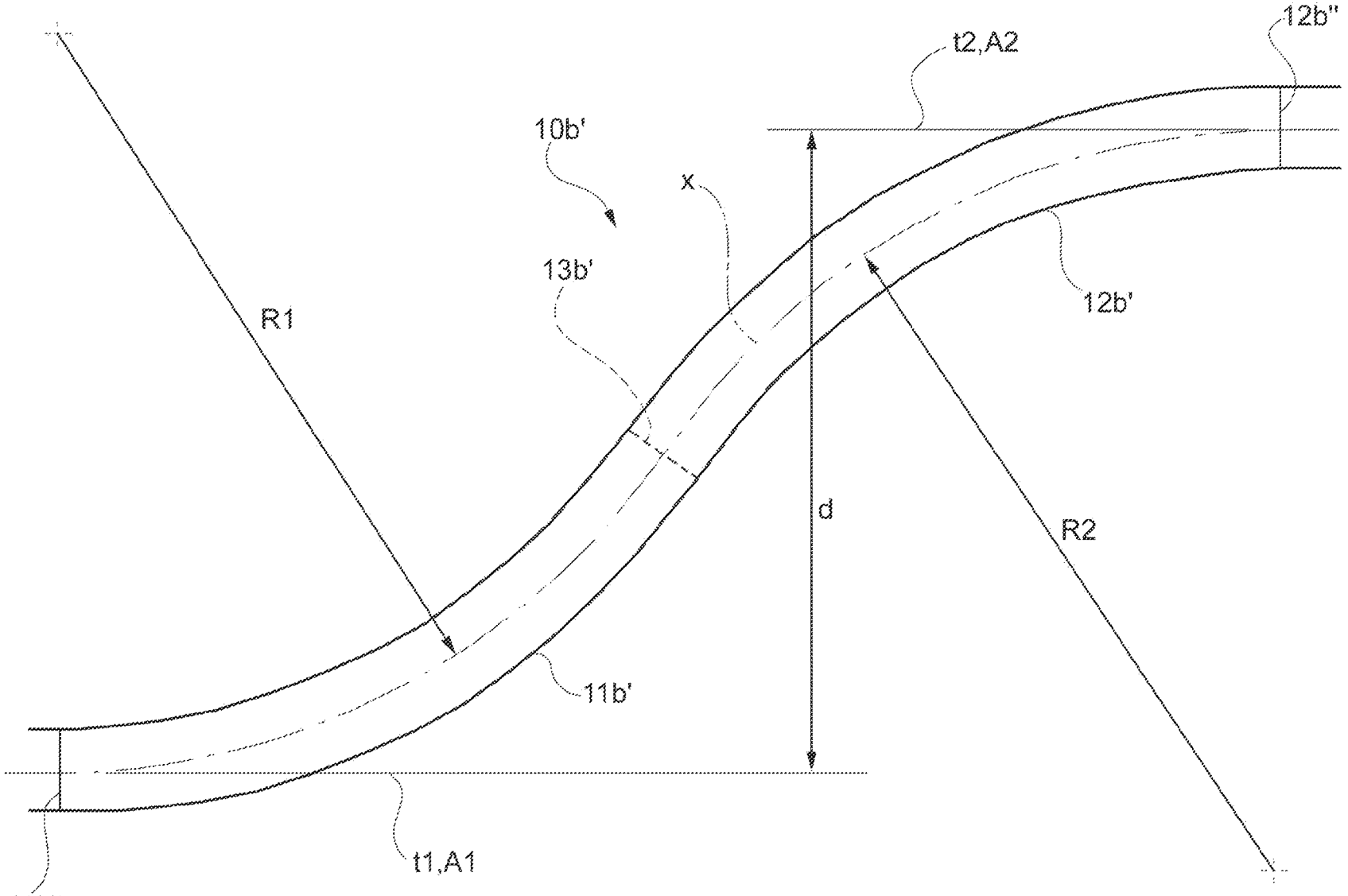
FIG. 5 is an elevation view of an inflection portion obtained in the first step of the method according to the present invention, FIG. 6 schematically shows a second step of the method according to the present invention for obtaining the tubular product of FIG. 1, and FIGS. 7 and 8 are perspective views of a form-bound bending device of an apparatus for manufacturing tubular products according to the present invention.
Figure 6:
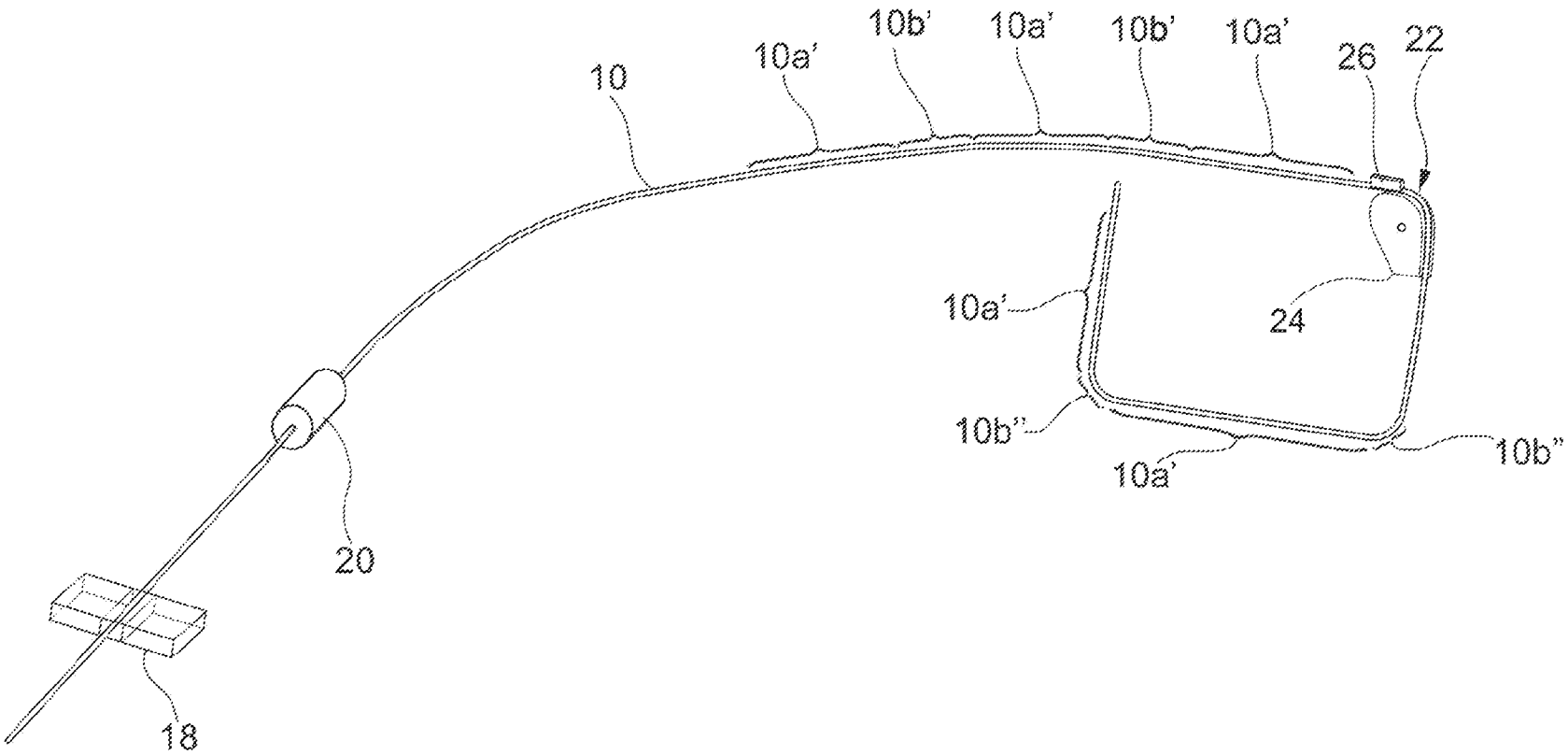

With reference to FIGS. 4 to 6, the method of manufacturing the tubular product 10' starting from a tube 10 made of metal material will be described.

The tube 10 is represented in the drawings as a tube with a circular cross section, but it may have a cross section with a different shape.

The longitudinal axis, initially rectilinear, of the tube 10 is indicated with x. 10*a* indicates first straight portions of the tube 10 corresponding, in the final tubular product 10', to the first curved portions 10*a*', while 10*b* indicates second straight portions of the tube 10 corresponding, in the final tubular product 10', to the second bent curved portions or corner portions 10*b*". As shown in FIG. 4, the first straight portions 10*a* alternate with the second straight portions 10*b* and extend immediately adjacent to the second straight portions 10*b*.

The tubular product 10' is obtained according to the present invention by a manufacturing method comprising the steps of:

a) performing a plurality of first bending operations, each on a respective first straight portion 10*a* and on a respective second straight portion 10*b* of the tube 10, by a first bending device 20, and b) performing a plurality of second bending operations, each on a respective second portion 10*b* of the tube 10 which has already been subjected to a respective first bending operation, by a second bending device 22.

In particular, FIG. 4 shows step a), wherein the tube 10 is fed, by a feeding device 18 (of a per se known type and, therefore, only schematically shown in the drawings), to the first bending device 20 for performing the first bending operations.

The first bending operations are each performed on a respective first straight portion 10*a* of the tube 10 and on a respective second straight portion 10*b*, and each on a bending plane passing through the longitudinal axis x of the tube, in such a way that the tube 10 leaving the first bending device 20 comprises a corresponding plurality of first curved portions 10*a*' separated by second curved portions 10*b*'. The first curved portions 10*a*' and the second curved portions 10*b*' may lie on the same bending planes or on different bending planes. The curvature of the second curved portions 10*b*' is slight and therefore imperceptible in the representation of FIG. 4. Each of the second curved portions 10*b*' corresponds to the double S-curve, lying, however, on a plane passing through the longitudinal axis x of the tube. One of the second curved portions 10*b*' is specifically represented in FIG. 5. It should be noted that the curvatures of the second curved portion 10*b*' are exaggerated in FIG. 5 for clarity reasons. The second curved portion 10*b*' comprises a first curve 11*b*' and a second curve 12*b*' lying on the same bending plane. The first curve 11*b*' and the second curve 12*b*' have respective bending radii R1 and R2 (referring more precisely to the central axis x), which in FIG. 5 are represented as if they were the same value; however, this condition is not required. An inflection point 13*b*' is interposed between the first curve 11*b*' and the second curve 12*b*'. By way of reference, FIG. 5 also shows the ends 11*b*" and 12*b*" which, differently from what is shown in FIGS. 2 and 3, still lie in the same plane, i.e., the plane of the first curve 11*b*' and of the second curve 12*b*'. FIG. 5 also shows the tangents t1 and t2 and the distance d between the planes A1 and A2.

Preferably, the first bending device 20 is a free-form bending device, in which the desired bend is imparted to the tube by a movable part of the device exerting a deformation force on the advancing tube. An example of a bending device of this type is a roller-type bending machine.

A roller-type bending machine is generally capable of bending the tube only in a certain bending plane passing through the longitudinal axis of the tube. In order to change the bending plane, it is possible to change the relative orientation of the rollers with respect to the tube.

Another example of a free-form bending device is the so-called penetration bending machine, as described in U.S. Pat. No. 5,111,675 A. With such machines it is easier to change the plane of curvature of the tube.

FIG. 6 shows step b) of the method according to the present invention, wherein the tube 10 leaving the first bending device 20 is subjected to the second bending operations by a second bending device 22 located downstream of the first bending device 20.

The second bending operations are each performed on a respective second curved portion 10*b*' of the tube 10, in such a way that the tubular product 10' leaving the second bending device 22 comprises, between each pair of consecutive first curved portions 10*a*', a respective second bent curved portion or corner portion 10*b*".

Figure 7:
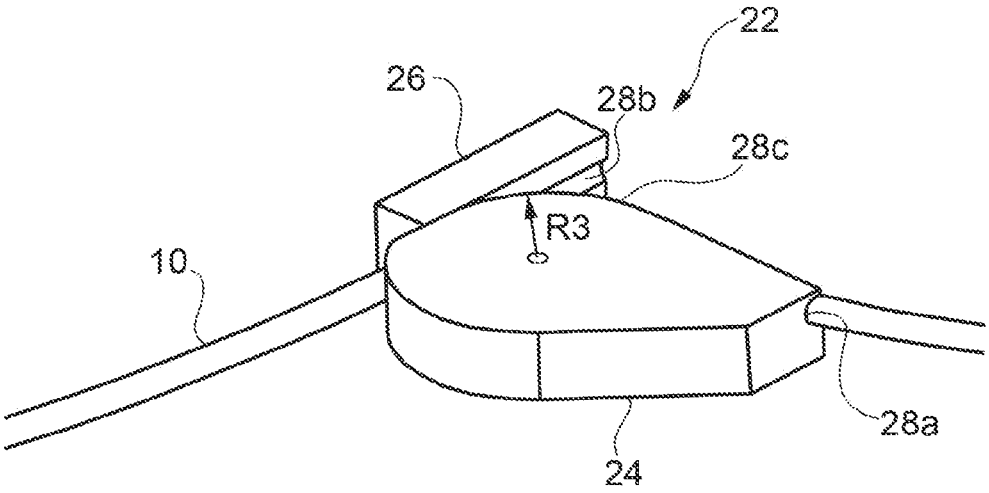
Figure 8:
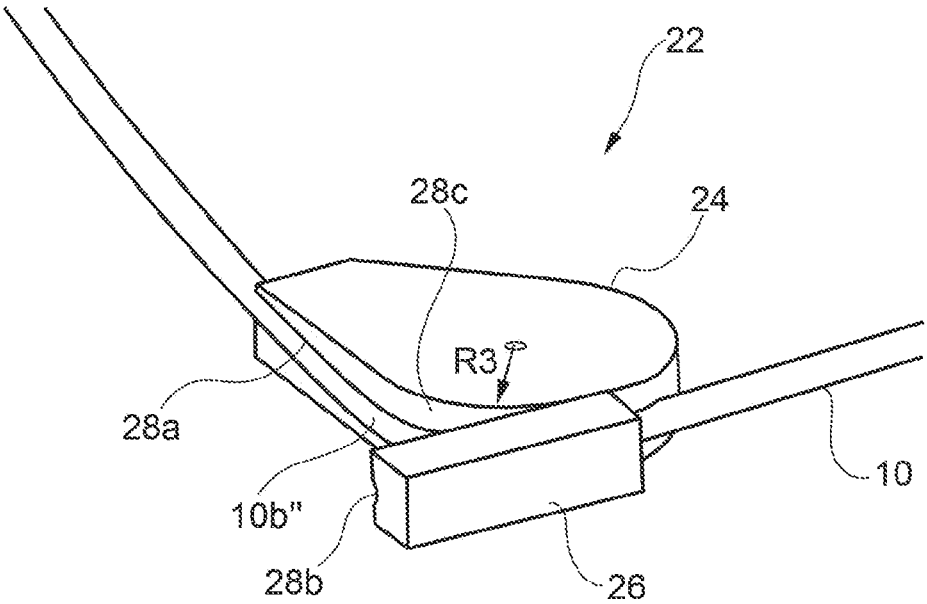

With reference to FIGS. 7 and 8, the second bending device 22 is a form-bound bending device, comprising, in a per se known manner, a mold or die 24, having a groove 28*a*, and at least one shoe or clamping vise 26 with a respective groove 28*b*. The shoe or clamping vise 26 is configured to act on the tube 10, in cooperation with the die 24, to bend the tube 10 according to a given curve. The second bending device 22 is configured to execute a corner curve superimposed on the second curved portion 10*b*' and lying on a cylindrical surface having generatrices orthogonal to the planes A1 and A2 shown in FIGS. 2 and 3. More generally, the second bending device 22 is configured to execute a corner curve superimposed on the second curved portion 10*b*', so that the resulting three-dimensional curve has tangents to the opposite ends of the curve lying on a cylindrical surface having generatrices orthogonal to the A1 and A2 planes shown in FIGS. 2 and 3. In the illustrated example, the grooves 28*a* and 28*b* are shaped to receive the double S-curve, and the groove 28*a* of the die 24 extends along a surface 28*c* of the die 24 which may be at least partly cylindrical. In particular, the grooves 28*a* and 28*b* may be dimensioned in such a way that the corner curve has a bending radius R3 (more precisely, a bending radius R3 at the central axis x) which is smaller than the bending radii R1 and R2 of the first curve 11*b*' and 12*b*'. The corner portion 10*b*" shown in FIGS. 2 and 3 is thus obtained.

The method according to the present invention may also comprise measuring the extent of advancement of the tube 10 and/or marking the tube 10 during advancement, respectively by a measuring device (not shown, but in any case, of a per se known type) and a marking device (not shown, but in any case, of a per se known type), such as an ink or laser marking device.

The method according to the present invention may be carried out, for example, by first performing all the first bending operations by the first bending device 20, to obtain all the first curved portions 10*a*' and the second curved portions 10*b*' of the tubular product 10', and then performing all the second bending operations by the second bending device 22, to obtain all the second corner portions 10*b*" of the tubular product 10'.

Alternatively, the method according to the present invention may be carried out, for example, by performing in sequence the first and second bending operations by the first and second bending devices 20 and 22 respectively to obtain a portion of the tubular product 10' each time comprising at least two first curved portions 10*a*' and, between each pair of first curved portions 10*a*', a second corner portion 10*b*".

In particular, when used for manufacturing an ELM coil having a plurality of turns 12, the method according to the present invention may be carried out either by making the turns all together, i.e. by first performing all the first bending operations and then all the second bending operations, or proceeding turn by turn, that is to say by first performing the first bending operations envisaged for a first coil and then the second bending operations envisaged for the first coil and then repeating these operations for the subsequent turns.

As already mentioned, a further aspect of the present invention relates to an apparatus for manufacturing complex-curvature tubular products starting with a metal tube extending along a rectilinear longitudinal axis x. This apparatus comprises, in addition to the feeding device 18, the first bending device 20 and the second bending device 22, support means (not shown, but in any case, of a known type) arranged between the first bending device 20 and the second bending device 22 to support the tube 10 leaving the first bending device 20.

The apparatus 30 may further comprise the measuring device and/or the marking device.

In the preceding description, a method has been described for obtaining a three-dimensional curve in a tubular product 10', applied to the manufacturing of a complex-curvature tubular product comprising first curved portions 10*a*' and second corner portions 10*b*". As may be appreciated, this specific method may find a more general application to obtain a three-dimensional curve comprising a first curve component having opposite ends extending on a plane, and a second curve component obtained by bending on a cylindrical surface the plane on which the ends of the first curve component lie.

The principle of the invention remaining unchanged, embodiments and constructional details may be modified with respect to those described and illustrated herein purely by way of non-limiting example, without thereby departing from the scope of protection as described and claimed herein. For example, the method of to the present invention may be not limited only to first and second bending operations, but further bending operations may be performed before the first bending operations, between the first and second bending operations, or after the second bending operations.

What is claimed is:

1. A method for obtaining a three-dimensional curve in a tubular product starting from a tube extending along a rectilinear longitudinal axis (x), the method comprising the steps of:

a) performing, by a first bending device, a first bending operation on a bending plane passing through said rectilinear longitudinal axis (x), in such a way that the tube leaving said first bending device comprises a curved portion having opposite ends, wherein a first tangent and a second tangent (t1, t2) to the curved portion at said opposite ends lie in said bending plane, wherein the curved portion comprises a first curve and a second curve lying on said bending plane, wherein an inflection point is interposed between said first curve and said second curve; and b) performing on the tube leaving said first bending device, by a second bending device, a second bending operation, in such a way that the curved portion of the tube has the first and second tangents (t1, t2) at said opposite ends lying on a cylindrical surface having generatrices orthogonal to a first plane (A1) containing the first tangent (t1) and to a second plane (A2) containing the second tangent.

2. The method of claim 1, wherein said first bending device is a free-form bending device.

3. The method of claim 1, wherein said second bending device is a form-bound bending device.

4. A method for manufacturing a complex-curvature tubular product starting from a tube extending along a rectilinear longitudinal axis (x), the method comprising the steps of:

a) performing, by a first bending device, a plurality of first bending operations, each bending operation of said plurality of first bending operations being performed on a respective first straight portion of the tube and on a respective second straight portion of the tube, and on a bending plane passing through said rectilinear longitudinal axis (x), in such a way that the tube leaving said first bending device comprises a respective plurality of first curved portions, separated by second curved portions, each second curved portion having opposite ends, wherein a first tangent and a second tangent (t1, t2) to the second curved portion at said opposite ends lie in a same bending plane; and b) performing on the tube leaving said first bending device, by a second bending device, a plurality of second bending operations, each bending operation of said plurality of second bending operations being performed on one of said second curved portions, in such a way that the tube leaving said second bending device comprises, between each pair of consecutive first curved portions, a respective second bent curved portion having the first and second tangents (t1, t2) at said opposite ends lying on a cylindrical surface having generatrices orthogonal to a first plane (A1) containing the first tangent (t1) and to a second plane (A2) containing the second tangent (t2), wherein the complex-curvature tubular product thus obtained comprises first curved portions and second bent curved portions immediately adjacent to each other.

5. The method of claim 4, wherein step a) comprises performing the plurality of first bending operations in such a way that each second curved portion of the tube leaving said first bending device comprises a first curve and a second curve lying on the same bending plane, wherein an inflection point is interposed between said first curve and second curve.

6. The method of claim 4, wherein said first bending device is a free-form bending device.

7. The method of claim 4, wherein said second bending device is a form-bound bending device.

* * * * *